US009926904B2

(12) United States Patent
Kolhouse et al.

(10) Patent No.: US 9,926,904 B2
(45) Date of Patent: Mar. 27, 2018

(54) VARIABLE IGNITION ENERGY MANAGEMENT

(71) Applicant: Cummins, Inc., Columbus, IN (US)

(72) Inventors: Steven J. Kolhouse, Columbus, IN (US); Samuel C. Geckler, Columbus, IN (US); David Stroh, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 700 days.

(21) Appl. No.: 14/506,032

(22) Filed: Oct. 3, 2014

(65) Prior Publication Data

US 2016/0097366 A1 Apr. 7, 2016

(51) Int. Cl.

| | |
|---|---|
| ***F02P 9/00*** | (2006.01) |
| ***F02P 15/08*** | (2006.01) |
| ***F02D 41/00*** | (2006.01) |
| ***F02M 25/07*** | (2006.01) |
| ***F02P 15/00*** | (2006.01) |
| *F02D 35/02* | (2006.01) |

(52) U.S. Cl.

CPC ..... *F02P 9/002* (2013.01); *F02D 41/005* (2013.01); *F02M 25/077* (2013.01); *F02M 25/0726* (2013.01); *F02M 25/0754* (2013.01); *F02M 25/0755* (2013.01); *F02P 15/006* (2013.01); *F02P 15/08* (2013.01); *F02D 35/023* (2013.01); *F02D 35/025* (2013.01); *F02D 35/027* (2013.01); *F02D 41/0072* (2013.01)

(58) Field of Classification Search

CPC ..... F02P 9/002; F02P 15/12

See application file for complete search history.

(56) References Cited

U.S. PATENT DOCUMENTS

| | | | | |
|---|---|---|---|---|
| 4,255,789 A | | 3/1981 | Hartford et al. | |
| 4,696,280 A | * | 9/1987 | Niggemeyer | F02P 3/0884 123/598 |
| 4,947,810 A | * | 8/1990 | Gillbrand | F02B 77/04 123/169 CL |

(Continued)

FOREIGN PATENT DOCUMENTS

| | | |
|---|---|---|
| DE | 10 2007 029 953 | 1/2009 |
| EP | 0 305 348 | 3/1989 |

(Continued)

OTHER PUBLICATIONS

International Search Report and Written Opinion for PCT/US2015/053427, dated Jan. 7, 2016, 14 pages.

(Continued)

*Primary Examiner* — Stephen K Cronin
*Assistant Examiner* — Arnold Castro
(74) *Attorney, Agent, or Firm* — Foley & Lardner LLP

(57) ABSTRACT

A method for energy ignition management of a spark-ignition engine includes receiving, by a controller, at least one ignition energy characteristic to affect control of at least one combustion cylinder. The method further includes controlling the at least one combustion cylinder via the controller. Controlling the at least one combustion cylinder via the controller includes adjusting the at least one ignition energy characteristic in response to at least one operating condition of the engine. The at least one ignition energy characteristic is a magnitude of one of a current or voltage of spark energy.

16 Claims, 3 Drawing Sheets

(56) References Cited

U.S. PATENT DOCUMENTS

| | | | | |
|---|---|---|---|---|
| 5,333,593 | A * | 8/1994 | Morganti | F02P 3/02 123/637 |
| 5,701,865 | A | 12/1997 | Thomas et al. | |
| 7,997,255 | B2 | 8/2011 | Asada et al. | |
| 2009/0114188 | A1 | 5/2009 | Peters et al. | |
| 2009/0308070 | A1 | 12/2009 | Alger et al. | |
| 2010/0206267 | A1 | 8/2010 | Glugla et al. | |
| 2010/0235070 | A1 | 9/2010 | Amano | |
| 2011/0253100 | A1 | 10/2011 | Kaiser et al. | |
| 2012/0303247 | A1 | 11/2012 | Minami et al. | |
| 2014/0196702 | A1 | 7/2014 | Gingrich et al. | |
| 2015/0128683 | A1* | 5/2015 | Kumano | F02D 35/026 73/35.08 |
| 2015/0369202 | A1* | 12/2015 | Shiraishi | F02P 3/055 123/594 |

FOREIGN PATENT DOCUMENTS

| | | |
|---|---|---|
| EP | 0 640 761 | 3/1995 |
| JP | S59-126041 | 7/1984 |
| JP | 06-002639 | 1/1994 |
| JP | H06-2639 | 1/1994 |
| JP | 2000-291519 | 10/2000 |
| WO | WO-2013/175091 | 11/2013 |
| WO | WO 2014/010246 | 1/2014 |

OTHER PUBLICATIONS

International Search Report and Written Opinion for PCT Application PCT/US2015/051094, dated Dec. 14, 2015, 10 pages.

* cited by examiner

VARIABLE IGNITION ENERGY MANAGEMENT

FIELD OF THE INVENTION

The present invention relates generally to the field of ignition control for engines. More particularly, the present invention relates to methods and devices involving controlling spark energy in spark ignition engines.

BACKGROUND

Many types of engines, such as internal combustion engines, include a plurality of cylinders. The ignition timing for the cylinders may be controlled in the same manner for all of the cylinders. Thus, for example, all four cylinders of a particular engine may be controlled in accordance with the same control regime.

SUMMARY OF THE INVENTION

Embodiments of the present invention provide devices and methods for variable ignition energy management for engines. Such embodiments allow for adjustment of particular ignition characteristics for one or more cylinders of an engine based on various engine operating conditions. The characteristics can include, but are not limited to, a total energy amount, timing, amplitude, duration and waveform shape, for example. The particular ignition characteristics can be controlled on a cylinder-by-cylinder basis or at the engine level.

In one embodiment, a method for energy ignition management of a spark-ignition engine includes receiving, by a controller, at least one ignition energy characteristic to affect control of at least one combustion cylinder. The method further includes controlling the at least one combustion cylinder via the controller. Controlling the at least one combustion cylinder via the controller includes adjusting the at least one ignition energy characteristic in response to at least one operating condition of the engine. The at least one ignition energy characteristic is a magnitude of spark energy. The magnitude is an amplitude of at least one of a current or voltage of the spark energy.

In one embodiment, a method for energy ignition management of a spark-ignition engine includes receiving, by a controller, at least one ignition energy characteristic to affect control of a plurality of combustion cylinders. The at least one ignition energy characteristic corresponds to a magnitude of spark energy. The method further includes adjusting the at least one ignition energy characteristic in response to at least one operating condition of the engine.

Certain embodiments encompass devices that are designed to implement the above-described methods.

In one embodiment, an apparatus configured to manage energy ignition of a spark-ignition engine includes an engine control unit configured to control a plurality of combustion cylinders of the spark-ignition engine. The apparatus further includes an ignition control unit configured to communicate with the engine control unit and to control at least one ignition energy characteristic, and an engine exhaust system. The engine exhaust system comprises an EGR valve, an input throttle and an output throttle, an air filter through which ambient air is filtered prior to entering the input throttle, an exhaust through which air that has passed through the exhaust throttle is discharged, an exhaust manifold, an intake manifold, and a cooling system comprising a charge-air cooler and an EGR cooler, the cooling system being communicated with the engine exhaust system. The engine control unit is configured to receive data collected by a plurality of sensors on the engine exhaust system and to provide a fuel command to the engine exhaust system based on the collected data. The ignition control unit is configured to adjust the at least one ignition energy characteristic in response to at least one operating condition of the engine. The at least one ignition energy characteristic is a magnitude of spark energy.

Additional features, advantages, and embodiments of the present disclosure may be set forth from consideration of the following detailed description, figures, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE FIGURES

The accompanying figures illustrate embodiments of the present disclosure and, together with the detailed description, serve to explain the principles of the invention.

In the figures, like reference characters generally refer to like features (e.g., functionally similar and/or structurally similar elements).

DETAILED DESCRIPTION OF PREFERRED EMBODIMENTS

Figure 1:
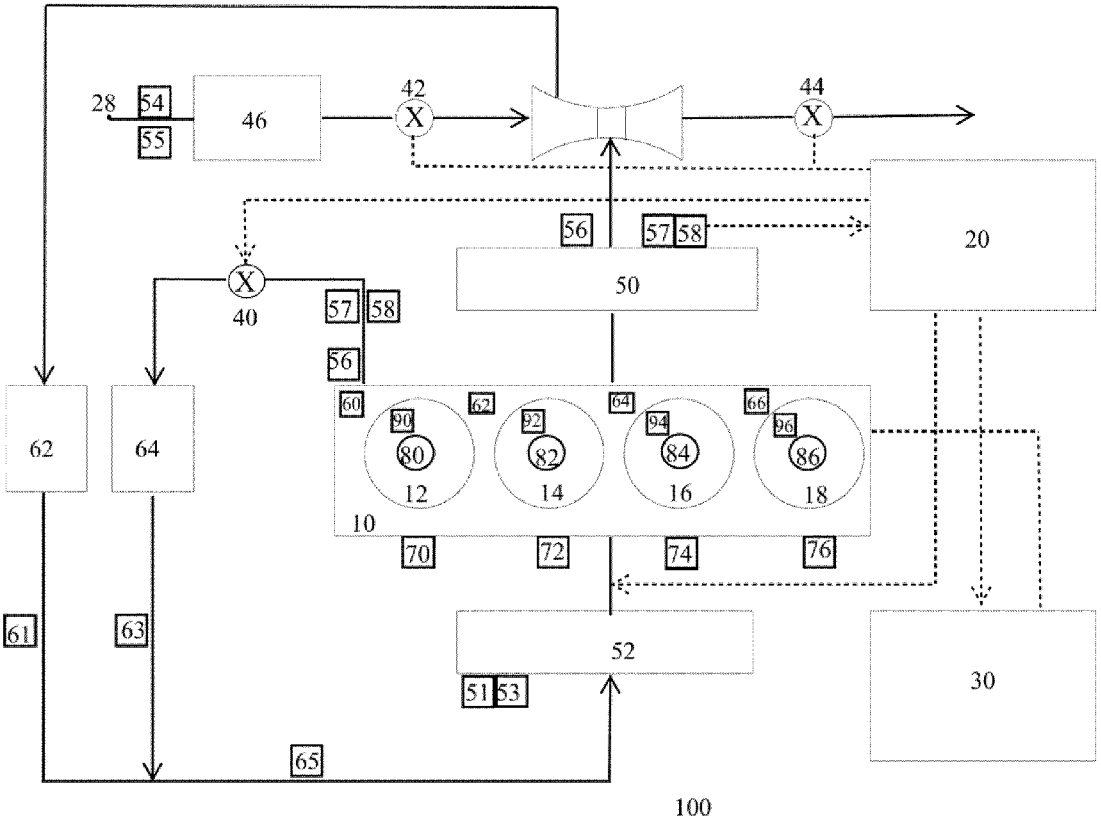
FIG. 1 is a schematic diagram of a variable energy management system implemented in a vehicle, according to an example embodiment.

In the following detailed description, reference is made to the accompanying figures, which form a part hereof. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be performed, arranged, substituted, combined, and designed in a wide variety of different configurations.

The embodiments described below relate to methods and devices for variable ignition energy management for engines. In such embodiments, energy is managed by adjusting particular ignition characteristics, such as an amount of spark energy, for one or more cylinders of an engine based on various engine operating conditions. By way of illustration, the ignition characteristics may further include a total energy amount, timing, amplitude, duration and waveform shape. 'Amplitude,' in the context of spark energy, may describe an amplitude of one of a current or a voltage. Such characteristics may be controlled separately on a cylinder-by-cylinder basis so as to improve or optimize an amount of spark energy per cylinder, or controlled at an engine level.

By controlling ignition characteristics according to a cylinder-by-cylinder approach, spark energy for each cylinder may be optimized. By optimizing the spark energy, at least some embodiments may realize significant performance improvements. In some circumstances, limiting the spark energy based on predetermined conditions may allow for a longer spark plug lifetime.

In some embodiments, the characteristics to be controlled on an individual cylinder basis may relate to exhaust gas recirculation ("EGR") techniques used in a vehicle. For example, in some embodiments, ignition characteristics may be modified based on an estimated EGR fraction per cylinder.

At least some embodiments include an ignition system providing a plurality of parameters for calibrating ignition in response to engine operating conditions. In some embodiments, for example, each cylinder can be calibrated in accordance with a first control regime at a first time, and subsequently calibrated in accordance with a second control regime at a second time.

In a spark ignition engine having a plurality of cylinders, a determination of which cylinder is an igniting cylinder may be made so as to permit controlling of individual spark timings for each of the plurality of cylinders. Controlling spark timing may be undertaken to enhance cylinder balancing, for example. Controlling spark timing differs from directly controlling the amount of energy associated with ignition of individual cylinders, however. Controlling the amount of energy directly—and not just the timing—can allow for extending the lifetime of spark plugs, as noted above.

Some embodiments allow for independent control of a duration, an amplitude, and a discharge profile of each of a plurality of cylinders based on ignition energy, among other characteristics. In contrast, other embodiments allow for a common adjustment of spark energy at an engine level, i.e., with applicability to the plurality of cylinders as a whole rather than to individual cylinders. Both embodiments permit adjustment of at least one ignition energy characteristic in response to at least one engine operating condition.

More particularly, some embodiments may allow for adjustment of spark energy at an individual cylinder level by calibrating at least one ignition energy characteristic for at least one individual combustion cylinder in response to at least one engine operating condition. The engine operating conditions may include, but are not limited to, an EGR fraction, a lambda value corresponding to an air-fuel ratio, an in-cylinder pressure, an in-cylinder temperature, a knock detection metric, a misfire detection, a cylinder balancing determination, a charge flow, an intake air temperature, a determination based on transient conditions, and an EGR quality metric. The aforementioned operating conditions of the EGR fraction, the air-fuel ratio, the in-cylinder pressure, and the in-cylinder temperature may be determined based on any combination of sensed values and/or estimated values.

Referring now to FIG. 1, a system 100 configured to manage ignition energy of a spark-ignition engine 10 is shown. The system 100 includes an engine control unit 20 configured to control a plurality of combustion cylinders 12, 14, 16, 18 of the spark-ignition engine 10. The combustion cylinders 12, 14, 16 and 18 are respectively provided with spark plugs 80, 82, 84 and 86. Each of the spark plugs 80, 82, 84 and 86 is disposed at a top of the respective cylinder head and is configured to ignite a mixture of air and fuel in the combustion chamber and transfer heat away from the chamber.

The engine 10 is configured with fuel injectors 70, 72, 74 and 76. In some embodiments, the fuel injectors 70, 72, 74 and 76 may be direct fuel injectors that are mounted in the heads of the cylinders 12, 14, 16 and 18, respectively, and which spray fuel directly into the engine cylinders to mix with air. In other embodiments, the fuel injectors 70, 72, 74 and 76 may be port injectors that spray fuel into intake ports to mix with incoming air.

In addition to the engine control unit 20, the system 100 further includes an ignition control unit 30. The ignition control unit 30 is configured to communicate with the engine control unit 20 and to control at least one ignition energy characteristic, such as a magnitude (amplitude) of spark energy. In addition, the system 100 includes an engine exhaust system having various components to be described below.

Referring again to FIG. 1, the engine exhaust system of the system 100 includes an EGR valve 40, an input throttle 42, and an exhaust throttle 44. Ambient air 28 enters the system and is filtered through an air filter 46 prior to entering the input throttle 42. Air that has passed through the exhaust throttle 44 is discharged on an exhaust side 48. The system 100 further includes an exhaust manifold 50, an intake manifold 52, and a cooling system including a charge-air cooler 62 and an EGR cooler 64. The cooling system comprising the coolers 62, 64 is in communication with the engine exhaust system, for example, via the manifolds 50, 52.

Still referring to FIG. 1, the system 100 includes a plurality of sensors that may be distributed on various components of the system 100, centralized in a single location, or grouped in multiple locations. In the configuration shown in FIG. 1, the plurality of sensors includes an altitude sensor 54 positioned proximate to the air filter 46. The altitude sensor 54 is configured to detect an ambient air pressure. An ambient air temperature sensor 55 is located proximate to the altitude sensor 54. The plurality of sensors further includes at least one sensor arranged proximate to the exhaust manifold 50, such as an oxygen ($O_2$) sensor 56.

As shown in FIG. 1, the plurality of sensors may additionally include an exhaust manifold pressure sensor 57 and an exhaust manifold temperature sensor 58. In some implementations, another oxygen sensor 56, another exhaust manifold pressure sensor 57, and another exhaust manifold temperature sensor 58 may be provided.

Whereas the exhaust manifold sensor 57 and the exhaust manifold temperature sensor 58 are provided for the exhaust manifold 50, an intake air temperature sensor 51 and intake manifold pressure sensor 53 are provided for the intake manifold 52. The plurality of sensors may further include a temperature sensor and pressure sensors configured to detect pressure other than the ambient air pressure. The plurality of sensors includes at least one in-cylinder pressure sensor. For example, the sensors shown in FIG. 1 include in-cylinder pressure sensors 90, 92, 94 and 96 respectively provided on cylinders 12, 14, 16 and 18.

As further illustrated in FIG. 1, the cooling elements of the system 100 may be provided with additional sensors. For example, a mass-air flow rate sensor 61 may be provided in proximity to the charge-air cooler 62, while an EGR flow rate sensor 63 may be provided for the EGR cooler 64. Another sensor, namely, a charge-air flow rate sensor 65, may be disposed so as to detect the flow rate of air prior to the air entering the engine 10.

Referring once again to FIG. 1, the plurality of sensors in the system 100 may still further include at least one knock sensor, such as the knock sensors 60, 62, 64 and 66. The knock sensors 60, 62, 64 and 66 are configured to detect vibration noise of the engine 10 so as to identify a combustion condition. In some embodiments, the knock sensors 60, 62, 64 and 66 are accelerometers. Data derived from the knock sensors 60, 62, 64 and 66 may be sent to the ignition control unit 30. Information from certain sensors, such as pressure sensors for the engine exhaust system, may be sent to the engine control unit 20 rather than the ignition control unit 30.

With further reference to FIG. 1, inputs and outputs to and from the engine control unit 20 and the ignition control unit 30 are indicated by dashed arrows. Each of the engine control unit 20 and the ignition control unit 30 is configured to receive information and output commands. The engine control unit 20 communicates with the ignition control unit 30, for example, by providing commands based on information obtained from at least some of the plurality of sensors. Such commands may be ignition energy and timing commands.

More particularly, the engine control unit 20 is configured to receive data collected by a plurality of sensors on the engine exhaust system and to provide a fuel command to the engine exhaust system based on the collected data. The ignition control unit 30 is configured to adjust the at least one ignition energy characteristic in response to at least one operating condition of the engine. As described above, the at least one ignition energy characteristic may be a magnitude of spark energy.

Furthermore, in some embodiments, a command sent from the engine control unit 20 to the ignition control unit 30 may be an ignition energy command instructing the ignition control unit 30 to alter an amount of spark energy to be supplied by each of the spark plugs 80, 82, 84 and 86. In some embodiments, the ignition control unit 30 is commanded to alter a total spark energy amount to be supplied by all of the spark plugs 80, 82, 84 and 86. In some embodiments, the engine control unit 20 may send a first command to the ignition control unit 30 to alter an amount of spark energy for the spark plug 80, a second command to alter an amount of spark energy for the spark plug 82, a third command to alter an amount of spark energy for the spark plug 84, and a fourth command to alter an amount of spark energy for spark plug 86. In some embodiments, the engine control unit 20 may issue the aforementioned first, second, third and fourth commands simultaneously or consecutively.

Referring yet again to FIG. 1, the ignition control unit 30 can thus control the spark plugs 80, 82, 84 and 86 independently of each other. For example, the ignition control unit, based on commands from the engine control unit 20, may adjust its control of spark plug 80 so as to increase an amount of ignition energy, and may also adjust its control of the spark plug 82 to decrease an amount of ignition energy.

In addition, the engine control unit 20 sends at least one command to the EGR valve 40, such as a command to change a valve position. The engine control unit 20 also sends at least one fuel command to the fuel injectors 70, 72, 74 and 76. Furthermore, in some embodiments, the engine control unit 20 sends a throttle command to the input throttle 42 and a command to the exhaust throttle 44. The commands to the throttles 42, 44 may be adjusted by the engine control unit 20 in accordance with information received from the ambient air temperature sensor 55, the ambient air pressure sensor 54, the exhaust manifold pressure sensor 57, the exhaust manifold temperature sensor 58, and the in-cylinder pressure sensors 90, 92, 94 and 96.

The configuration shown in FIG. 1 thus allows for the engine control unit 20 to adjust one or more ignition energy characteristics to be used for controlling one or more of the individual combustion cylinders 12, 14, 16 and 18 in response to one or more engine operating conditions. For example, an EGR fraction and an EGR quality metric are engine operating conditions that may be ascertained based on the oxygen sensor 56 and the EGR flow rate sensor 63, among other sensors distributed in the system 100. The EGR fraction may be a sensed or estimated value, for example. By further way of illustration, the in-cylinder pressure is an engine operating condition that may be detected based on the in-cylinder pressure sensors 90, 92, 94 and 96 respectively provided for the cylinders 12, 14, 16 and 18. Likewise, the knock detection metric is an engine operating condition that may be determined from the knock detection sensors 60, 62, 64 and 66 respectively provided for each of the plurality of cylinders 12, 14, 16 and 18.

In some embodiments, the engine control unit 20 can, based on the temperature, pressure, and flow rate sensors described above, determine other engine operating conditions. For example, from the information gleaned from the in-cylinder pressure sensors 90, 92, 94 and 96 and additional data inputs, the engine control unit 20 can determine an in-cylinder temperature. In this manner, the engine control unit 20 can account for engine operating conditions including an air-fuel ratio, a misfire detection, a cylinder balancing determination, a charge flow, an intake air temperature, a determination based on transient conditions that may be determined based on any combination of sensed values and/or estimated values.

As noted above, some embodiments allow for independent control of a duration, an amplitude (that is, an amplitude of at least one of a current or a voltage), and a discharge profile of each of the cylinders 12, 14, 16 and 18 based on a spark energy amount, among other characteristics. In contrast, other embodiments allow for a common adjustment of a spark energy amount at an engine level, i.e., with applicability to the plurality of cylinders 12, 14, 16 and 18 as a total system such that all of the cylinders 12, 14, 16 and 18 are treated in an identical manner.

Figure 2:
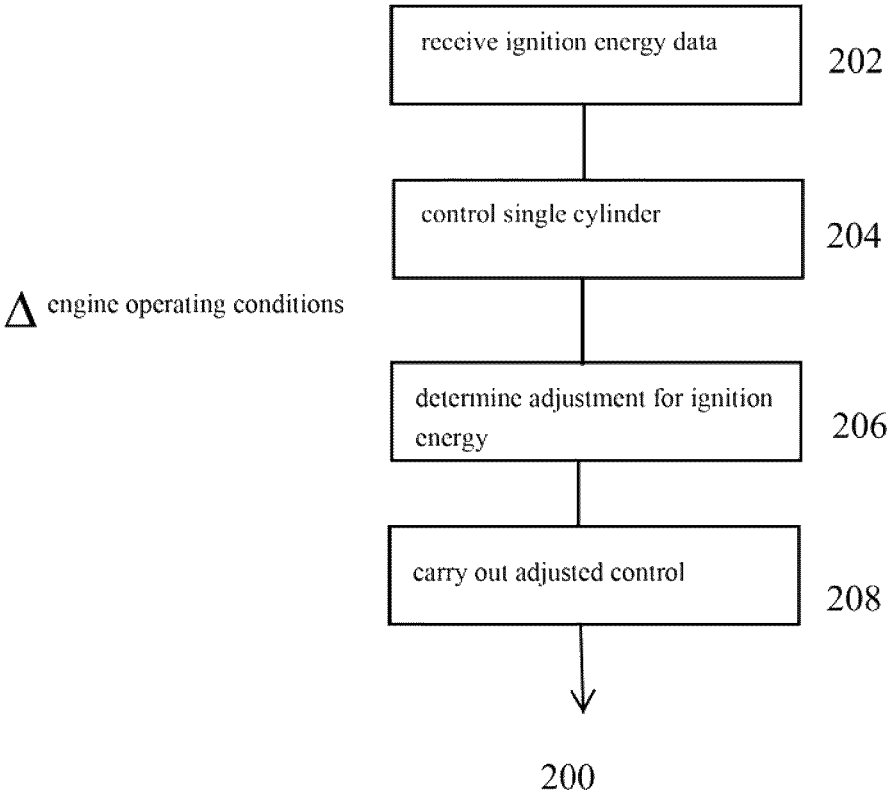
FIG. 2 is a flow diagram according to an example embodiment relating to variable energy management of individual cylinders.

FIG. 2 depicts a method 200 for energy ignition management of the spark-ignition engine 10 in which the cylinders 12, 14, 16 and 18 are controlled individually. The method 200 includes receiving at least one ignition energy characteristic and controlling at least one cylinder by adjusting the at least one ignition energy characteristic. More particularly, receiving at least one ignition energy characteristic (202) includes receiving information related to at least one ignition energy characteristic—such as the amount of ignition energy—by the engine control unit 20. The received information is used to affect control of one of the cylinders 12, 14, 16 and 18. The engine control unit 20 is configured to control the one of the cylinders 12, 14, 16 and 18 accordingly (204). When at least one operating condition of the engine changes, the method 200 includes adjusting (206) the at least one ignition energy characteristic to be supplied by the engine control unit 20 to the ignition control unit 30. Once the at least one ignition energy characteristic has been adjusted (206), the engine control unit 20 carries out control in accordance with the adjusted ignition energy characteristic (208).

In an embodiment providing for individual cylinder control, for example, the engine operating conditions include a sensed or estimated EGR fraction, a sensed or estimated air-fuel ratio, a sensed or estimated in-cylinder pressure, a sensed or estimated in-cylinder temperature, a knock detection metric, a misfire detection metric, a cylinder balancing need determination, a charge flow, an intake air temperature, transient conditions that can be managed by the engine control unit 20, and an EGR quality metric.

A transient condition exists when going from a 'high-load' to a 'light-load' operating point. In at least some embodiments, when situations give rise to such transient conditions, a variable energy ignition system (e.g., the system 100) aids combustion. More particularly, the system aids combustion because there is a period that is a lag time when a higher EGR fraction is present in the cylinder, but the engine has already transitioned to a lighter-load condition. In these circumstances, increasing the ignition energy may be beneficial.

Figure 3:
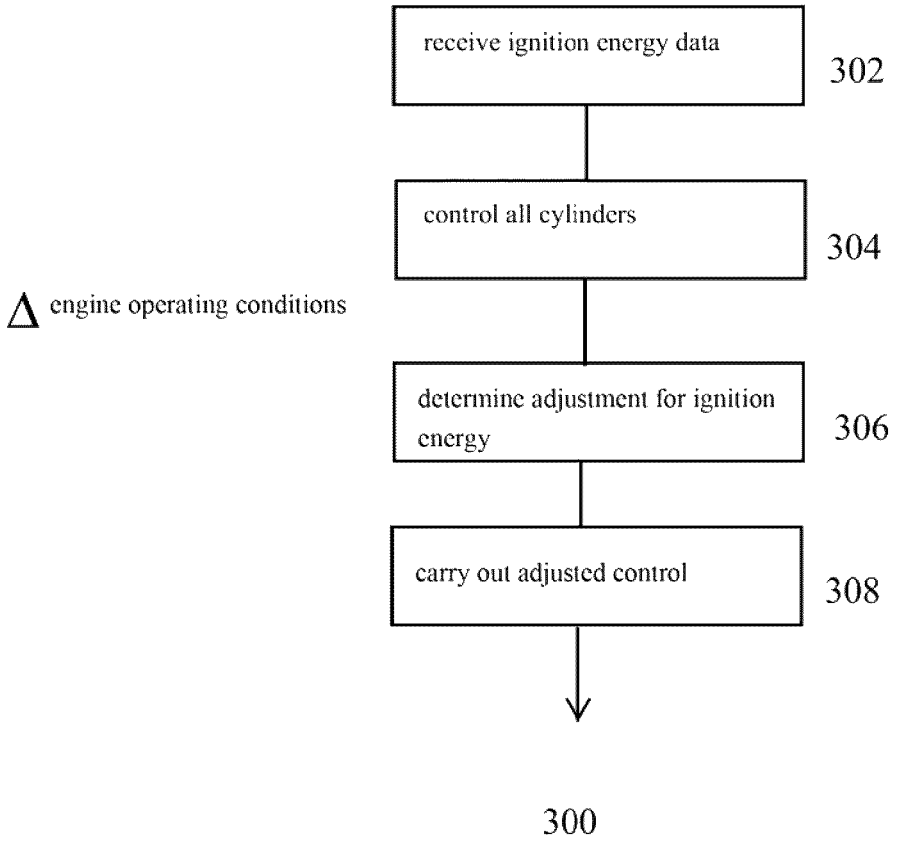
FIG. 3 is a flow diagram according to an example embodiment relating to variable energy management at an engine level.

FIG. 3 depicts a method 300 for energy ignition management of the spark-ignition engine 10 in which the cylinders 12, 14, 16 and 18 are controlled together, rather than individually, by the engine control unit 20. The method 300 reflects the engine-level approach of certain embodiments as described above. The method 300 includes receiving at least one ignition energy characteristic and controlling the plurality of cylinders by adjusting the at least one ignition energy characteristic. In some embodiments, the method 300 may be similar or analogous to the method 200 except that each one of the cylinders 12, 14, 16 and 18 is controlled in the same manner as all of the other cylinders.

In the method 300, receiving at least one ignition energy characteristic (302) includes receiving information pertaining to at least one ignition energy characteristic by the engine control unit 20. The received information is used to affect control of all of the cylinders 12, 14, 16 and 18 such that all of the cylinders 12, 14, 16 and 18 are controlled in a uniform manner (304). The method 300 further includes adjusting (306) the at least one ignition energy characteristic to be supplied by the engine control unit 20 to the ignition control unit 30 when at least one operating condition of the engine changes. The engine control unit 20 carries out control in accordance with the adjusted ignition energy characteristic (308) following adjustment of the at least one ignition energy characteristic (306).

In engine-level embodiments in which the cylinders are controlled together, the engine operating conditions include many of the engine operating conditions noted above in the individual cylinder embodiments. These common engine operating conditions—that is, common to management approaches at the individual cylinder level and the overall engine level—include the sensed or estimated EGR fraction, the sensed or estimated air-fuel ratio, the sensed or estimated in-cylinder pressure, the sensed or estimated in-cylinder temperature, the knock detection metric, and the charge flow.

However, the engine-level embodiments include certain engine operating conditions applicable at the engine level rather than the individual cylinder level. The engine operating conditions that are accounted for by the engine control unit 20 in managing the ignition energy for all of the cylinders 12, 14, 16 and 18 in tandem include a gas quality metric, a mass air flow rate, an engine load, an intake manifold temperature, a coolant temperature, and an engine speed. Thus, in the engine-level embodiment, an amount of ignition energy to be provided to all of the cylinders may be adjusted based on a temperature of the intake manifold and/or a temperature of the coolant during either a cold or a hot start of the engine 10.

Other engine operating conditions may be provided as inputs to the engine control unit 20 for managing ignition energy at the engine level for the spark ignition engine 10. These additional engine operating conditions include a dual fuel mode, a substitution rate, whether the fuel injectors 70, 72, 74 and 76 are configured as direct injectors or port injectors, ethanol boosting (dual fuel) for the direct injector and port injector configurations, water injection, a regeneration mode, and a torque control. Additionally, the engine-level approach to managing ignition energy for the cylinders 12, 14, 16 and 18 can implement management techniques to optimize the life of the spark plugs 80, 82, 84 and 86. To this end, other engine operating conditions to be accounted for include a sensed or measured system or component age, a sensed or estimated spark plug age, and a sensed or measured spark plug resistance.

Furthermore, in the engine-level embodiments, adjusting at least one ignition characteristic may include increasing an amount of spark energy following a shutdown of the engine 10 so as to enhance EGR scavenging.

At least some embodiments may be readily implemented into various spark ignition systems to achieve enhanced performance on a cylinder-by-cylinder or system-level basis and increased longevity of spark plugs.

In at least one embodiment, a variable valve lift (VVL) method may be employed to reduce intake valve lift. The use of VVL to reduce lift is alternative method of throttling the air into the combustion cylinders. However, in an air intake system designed to induce air swirl or tumble in the combustion cylinder, the throttling of intake air via reduced a valve lift will result in a suboptimal swirl or tumble motion in the charge air entering the cylinder. In this scenario, it is helpful to manage (and potentially optimize) the amount of spark energy per cylinder to help offset or otherwise account for the reduced swirl or tumble air flow. In some instances, such an approach can be implemented across all cylinders. In other instances, however, the reduced valve lift strategy may be employed on a cylinder-by-cylinder basis.

In another embodiment, the spark energy may be managed during periods of exhaust rebreathing in which spent exhaust gases are re-introduced into the combustion cylinder. Exhaust rebreathing can be managed via valve timing overlap utilizing a cam phasing method. In the valve timing overlap, the intake and exhaust valves both open with pressure balances such that the higher-pressure exhaust gases flow backwards into the cylinder. Alternatively, the exhaust rebreathing can be managed on a cylinder-by-cylinder basis via a variable valve actuation system. The exhaust re-breathing leads to a higher EGR fraction in the combustion cylinder, and the combustion in the cylinder may be managed and optimized via spark energy control as described above.

In yet another embodiment, gasoline compression engines beneficially utilize a variable energy ignition system as described above to aid 'part load' ignition in engines featuring lower compression ratio designs. Ideally, gasoline compression engines would not feature a spark plug, and ignition would occur in a diesel-like manner based on the pressure and temperature within the cylinder. However, in some operating condition scenarios, gasoline compression engines may benefit from and/or require spark assistance to achieve suitable ignition. The use of a variable energy ignition system advantageously permits gasoline compression ignition engines to utilize slightly lower compression ratios while still being able to achieve suitable ignition under part-load or light-load operating conditions.

Referring back to FIG. 1, the components of the system 100 shown in FIG. 1 are configured to be installed in a vehicle. The engine control unit 20 of the system 100 may be structured as an electronic control module ("ECM"). The ECM may include a transmission control unit and any other control unit included in a vehicle (e.g., exhaust after-treatment control unit, powertrain control module, etc.). Accordingly, the engine control unit 20 may be implemented as a processor, an application specific integrated circuit (ASIC), one or more field programmable gate arrays (FPGAs), a digital signal processor (DSP), a group of processing components, or other suitable electronic processing components.

Moreover, the engine control unit 20 may also include one or more memory devices. The one or more memory devices (e.g., RAM, ROM, Flash Memory, hard disk storage, etc.) may store data and/or computer code for facilitating the various processes described herein. Thus, the one or more memory devices may be communicably connected to the engine control unit 20 and provide computer code or instructions to the engine control unit 20 for executing the processes described in regard to the engine control unit 20 herein. Moreover, the one or more memory devices may be or include tangible, non-transient volatile memory or non-volatile memory. Accordingly, the one or more memory devices may include database components, object code components, script components, or any other type of information structure for supporting the various activities and information structures described herein.

In some embodiments, the engine control unit 20 and/or the ignition control unit 30 are configured to communicate with a data acquisition unit and an external control unit that may be integrated into a standalone system. Each of the data acquisition and the control unit may be connected for operation and utilization in conjunction with a plurality of apparatuses. Such apparatuses can include computers, diagnostic equipment, power sources, and monitors. In some embodiments, the data acquisition and the external control unit may provide information to at least one apparatus that is not physically connected to either the data acquisition unit or the external control unit.

The engine control unit 20 and/or the ignition control unit 30 may be configured to communicate with at least one input device and/or at least one output device, and may be configured to connect to additional systems via a logical network. The embodiments described herein may in some implementations allow for data relating to ignition energy to be accessed in a networked environment using logical connections to one or more computers having processors. For example, data relating to an amount of ignition energy may be made accessible by the engine control unit 20 for analysis. Various embodiments may employ different types of computer system configurations and may permit analysis of ignition energy via personal computers, hand-held devices, multi-processor systems, microprocessor-based or programmable consumer electronics, network PCs, mini-computers, mainframe computers, and the like.

Various embodiments are described in the general context of method steps, which may be implemented in one embodiment by a program product including computer-executable instructions, such as program code, executed by microprocessors or computers in various environments. Generally, program modules include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps.

Software implementations of the present invention could be accomplished with standard programming techniques with rule based logic and other logic to accomplish various steps. It should also be noted that the words "unit," "component" and "module," as may be used herein, are intended to encompass implementations using one or more lines of software code, and/or hardware implementations, and/or equipment for receiving manual inputs.

The present disclosure contemplates methods, systems, and programs on any machine-readable media for accomplishing various operations. As mentioned above, in certain embodiments, the controller forms a processing system or subsystem that includes one or more computing devices having memory, processing, and communication hardware. The processor may be a single device or a distributed device, and the functions of the processor may be performed by hardware and/or as computer instructions on a non-transient computer (or machine) readable storage medium. Such computer-readable media can be any available media that can be accessed by a general purpose or special purpose computer or other machine with a processor. By way of example, such computer-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor.

In certain embodiments, the system 100 includes a controller structured to perform certain operations. In certain embodiments, the controller forms a portion of a processing subsystem including one or more computing devices having memory, processing, and communication hardware. The controller may be a single device or a distributed device, and the functions of the controller may be performed by hardware and/or as computer instructions on a non-transient computer readable storage medium. In certain embodiments, the controller includes one or more modules structured to functionally execute the operations of the controller. In certain embodiments, the controller is configured as an engine control unit having one or more modules.

The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or as computer instructions on a non-transient computer readable storage medium, and modules may be distributed across various hardware or computer based components. More specific descriptions of certain embodiments of controller operations are included in the section referencing FIG. 1.

Example and non-limiting module implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

While this specification contains specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations may be depicted in a particular order, this should not be understood as requiring that such operations be performed in the particular order shown or in sequential order, or that all operations be performed, to achieve desirable results. Moreover, the separation of various aspects of the implementations described above should not be understood as requiring such separation in all implementations, and it should be understood that the described methods can generally be integrated in a single application or integrated across multiple applications.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

Thus, particular implementations of the invention have been described. Other implementations are within the scope of the following claims. In some cases, actions recited in the claims may be performed in a different order and still achieve desirable results. In addition, the depictions in the accompanying figures do not necessarily require a particular order or sequential order.

What is claimed is:

1. A method for energy ignition management of an engine, the method comprising:

receiving, by a controller, at least one ignition energy characteristic to affect control of at least one combustion cylinder, and controlling the at least one combustion cylinder via the controller, the control comprising adjusting the at least one ignition energy characteristic in response to at least one operating condition of the engine, wherein the at least one ignition energy characteristic is a magnitude of at least one of a current or voltage of ignition energy, wherein controlling the at least one combustion cylinder comprises controlling each of a plurality of combustion cylinders individually, wherein adjusting the at least one ignition energy characteristic comprises adjusting the magnitude of ignition energy based on a temperature of at least one of an intake manifold or a coolant temperature during a start of the engine, and wherein the at least one operating condition of the engine comprises at least one of a sensed in-cylinder pressure or an estimated in-cylinder pressure.

2. The method of claim 1, wherein adjusting the at least one ignition energy characteristic comprises independently adjusting the magnitude of ignition energy of each of a plurality of combustion cylinders.

3. The method of claim 1, wherein the at least one operating condition further comprises at least one condition selected from the group consisting of a sensed EGR fraction, an estimated EGR fraction, a sensed air-fuel ratio, an estimated air-fuel ratio, a sensed in-cylinder temperature, an estimated in-cylinder temperature, a knock detection metric, a misfire detection, a cylinder balancing requirement, a charge flow value, an intake air temperature, and a transient condition management requirement.

4. The method of claim 1, wherein adjusting the at least one ignition energy characteristic comprises adjusting at least one ignition energy characteristic of a first cylinder by a first adjustment, and adjusting at least one ignition energy characteristic of a second cylinder by a second adjustment.

5. A method for energy ignition management of an engine, the method comprising:

receiving, by a controller, at least one ignition energy characteristic to affect control of a plurality of combustion cylinders, the at least one ignition energy characteristic corresponding to a magnitude of at least one of a current or voltage of ignition energy, and adjusting the at least one ignition energy characteristic in response to at least one operating condition of the engine, wherein adjusting the at least one ignition energy characteristic comprises adjusting an ignition energy for each of the plurality of combustion cylinders, wherein adjusting the at least one ignition energy characteristic comprises adjusting the magnitude of ignition energy based on a temperature of at least one of an intake manifold or a coolant temperature during a start of the engine, and wherein the at least one operating condition comprises at least a sensed or estimated in-cylinder pressure.

6. The method of claim 5, wherein the ignition energy for each of the plurality of combustion cylinders is adjusted such that the combustion cylinders are uniformly adjusted.

7. The method of claim 5, wherein the at least one operating condition comprises at least one condition selected from the group consisting of an air-fuel ratio, a mass air flow, an intake manifold pressure, an intake manifold and/or a coolant temperature, a dual fuel mode, a substitution rate, a port injection mode, a direct injection mode, ethanol boosting, water injection, a regeneration mode, a torque control, a plug life optimization, a sensed system age, a measured system age, a sensed spark plug resistance or age, a measured spark plug resistance or age, an EGR fraction, a cylinder temperature, a knock detection metric, a charge flow rate, and an engine speed.

8. The method of claim 5, wherein adjusting the at least one ignition energy characteristic further comprises increasing the magnitude of ignition energy.

9. The method of claim 5, wherein adjusting the at least one ignition energy characteristic comprises adjusting a plurality of ignition energy characteristics.

10. The method of claim 5, wherein adjusting the at least one ignition energy characteristic comprises adjusting the magnitude of ignition energy based on the temperature of at least one of the intake manifold or the coolant temperature during a cold start of the engine.

11. The method of claim 5, wherein adjusting the at least one ignition energy characteristic comprises adjusting the magnitude of ignition energy based on the temperature of at least one of the intake manifold or the coolant temperature during a hot start of the engine.

12. An apparatus configured to manage energy ignition of an engine having a plurality of combustion cylinders, the apparatus comprising:

an ignition control unit configured to control at least one ignition energy characteristic, an engine exhaust system comprising an EGR valve, an air filter through which ambient air is filtered prior to entering an input throttle, an exhaust outlet through which air that has passed through an exhaust throttle is discharged, an exhaust manifold, and an intake manifold, wherein the ignition control unit is configured to adjust the at least one ignition energy characteristic in response to at least one operating condition of the engine, wherein the at least one ignition energy characteristic is a magnitude of at least one of a current or voltage of ignition energy, and wherein the ignition control unit is configured to adjust the at least one ignition energy characteristic by adjusting the magnitude of ignition energy based on a temperature of at least one of the intake manifold or a coolant temperature during exhaust rebreathing, and wherein the at least one ignition energy characteristic is adjusted based on at least a sensed or estimated in-cylinder pressure.

13. The apparatus of claim 12, wherein the at least one ignition energy characteristic is adjusted based on data from at least one of a plurality of sensors, the plurality of sensors including at least one of an altitude sensor, an ambient air pressure sensor, an oxygen sensor, a knock sensor, or a temperature sensor.

14. The apparatus of claim 12, wherein the at least one operating condition comprises at least one condition selected from the group consisting of a sensed EGR fraction, an estimated EGR fraction, a sensed air-fuel ratio, an estimated air-fuel ratio, a sensed in-cylinder pressure, an estimated in-cylinder pressure, a sensed in-cylinder temperature, an estimated in-cylinder temperature, a knock detection metric, a misfire detection, a cylinder balancing requirement, a charge flow value, an intake air temperature, and a transient condition management requirement.

15. The apparatus of claim 12, wherein the apparatus further comprises a plurality of spark plugs, and wherein each cylinder is provided with a corresponding knock sensor and in-cylinder pressure sensor.

16. The apparatus of claim 12, wherein the ignition control unit is configured to receive an ignition energy command and a timing command.

* * * * *